United States Patent [19]

Duncan

[11] 3,935,886

[45] Feb. 3, 1976

[54] FILLER TUBE

[75] Inventor: Alexander R. Duncan, Scarborough, Canada

[73] Assignee: The Molsons Companies Limited, Rexdale, Canada

[22] Filed: Feb. 5, 1974

[21] Appl. No.: 439,966

[30] Foreign Application Priority Data

July 31, 1973 Canada ..... 177748

[52] U.S. Cl. ..... 141/392

[51] Int. Cl.² ..... B65B 3/04

[58] Field of Search ..... 141/308, 295, 165, 166, 141/392, 312, 374, 255, 286

[56] References Cited

UNITED STATES PATENTS

| | | | |
|---|---|---|---|
| 2,333,036 | 10/1943 | Orndorff | 141/392 |
| 2,593,634 | 4/1952 | Vosburg | 141/295 |
| 2,639,851 | 5/1953 | Duncan | 141/286 |
| 3,037,536 | 6/1962 | Fechheiner et al. | 141/295 |
| 3,181,576 | 5/1965 | Pellerino et al. | 141/295 |
| 3,420,281 | 1/1969 | Tidwell | 141/392 |

*Primary Examiner*—Houston S. Bell, Jr.

*Attorney, Agent, or Firm*—Anthony J. Casella, Esq.

[57] ABSTRACT

This invention relates to a filler tube assembly for use in filling bottles with beverages and in which a fixed bottle centering housing has a flared lower end for receiving the tops of the empty bottles and in which the lower distal end of the filler tube is tapered and is provided with a circumferential groove having a number of filling holes.

1 Claim, 3 Drawing Figures

FILLER TUBE

This invention relates to bottle filling machines and in particular to the bottle filling tube assemblies incorporated therewith.

Such assemblies usually consist of a valve adaptor having a depending bottle filling tube whose lower tip is provided with beverage filling apertures, and a bottle centering housing slidably disposed on the tube, all of such parts usually being of metal. In the conventional filling machine, the empty bottles travel around a carousel and, during this time, pass beneath the filling assemblies. In this position the filling tube of such an assembly commences to enter the bottle and, in consequence, the housing disposes itself about the top of the bottle. Simultaneously, the tube and the adaptor remain stationary and the bottle moves upwardly, whereupon the bottle strikes the top of the housing. Obviously, and because of the metal parts employed, rubber gaskets have been provided in order to cushion the force of the moving integers. Additionally, and often as not, the tops of the filling tube strike the tops of the bottles and chip or fracture the glass as said tubes attempt to enter the bottles. Alternatively, and owing to vibration set up by the high speeds at which such bottle filling machines normally operate, it has been known for the filler tubes to bend when striking the top of the bottle.

It is the object of the present invention to overcome the above disadvantages by providing an improved bottle filling tube assembly.

Figure 1:
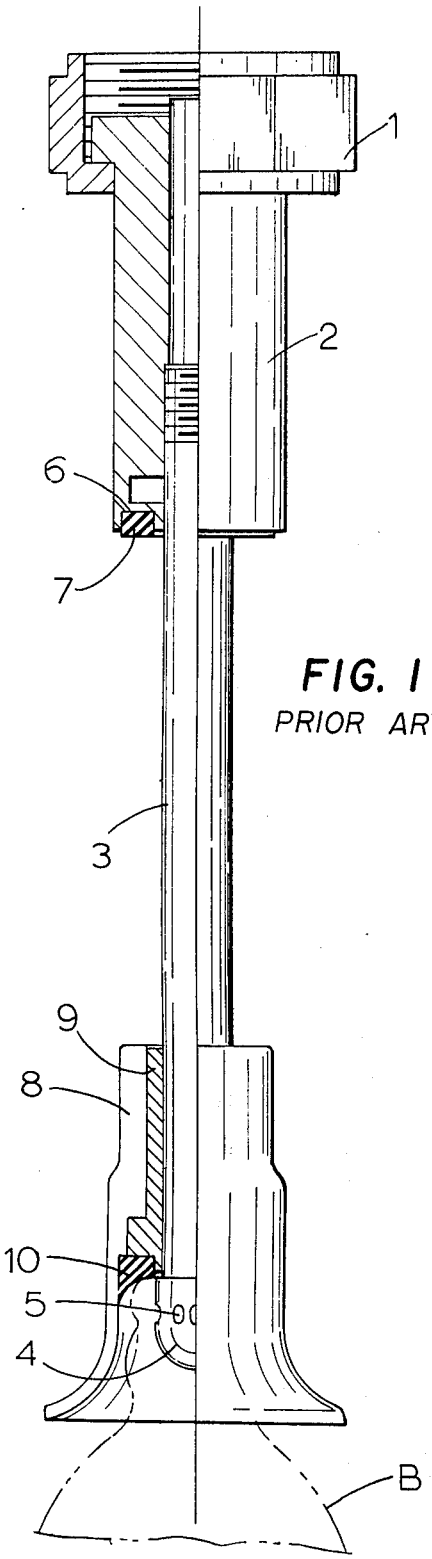
FIG. 1 PRIOR ART
Figure 2:
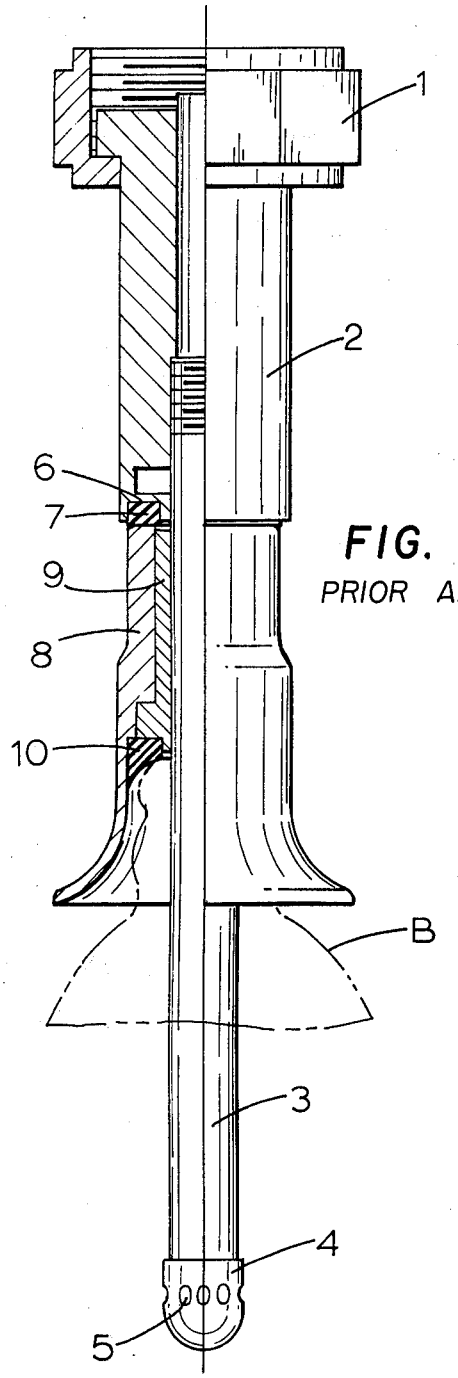
FIG. 2 PRIOR ART
Figure 3:
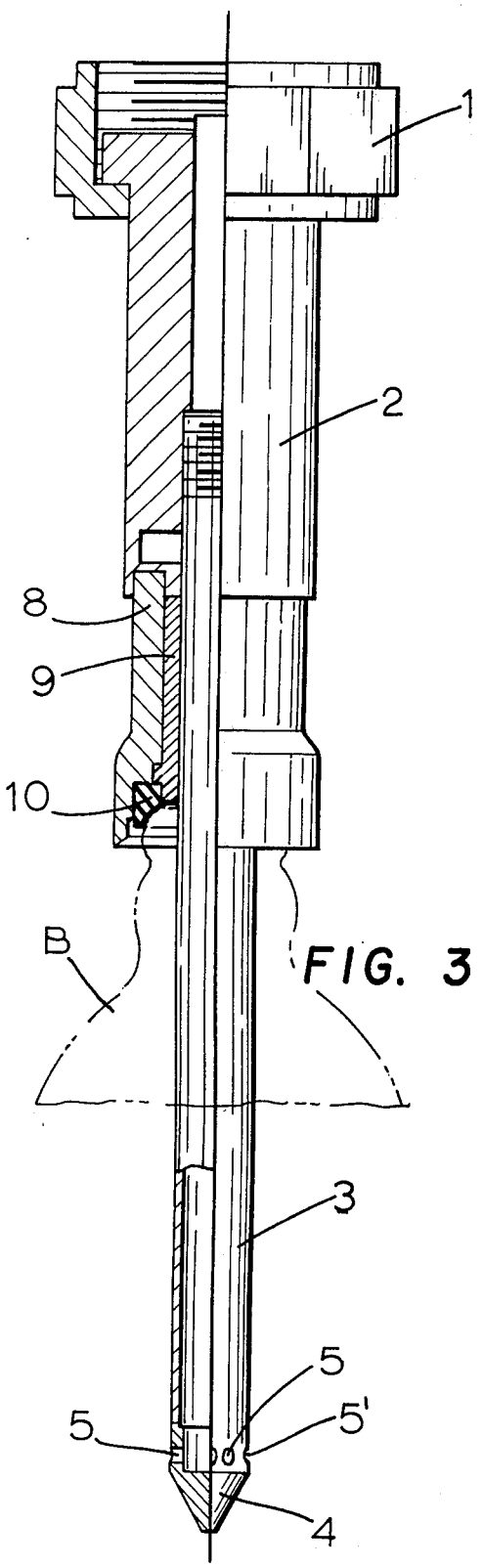

The invention is illustrated in the accompanying drawings in which FIGS. 1 and 2 are part sectional elevations of a conventional prior art type of filler tube assembly shown in an operative position and in relation to the top of the bottle; and FIG. 3 is a part sectional elevation of the improved filler tube assembly constructed according to the present invention and shown in an operative position in relation to a bottle.

Referring to the drawings, and in particular to FIGS. 1 and 2, the conventional filler tube assembly shown therein is secured in position on the filling machine by means of a large metal nut 1 disposed about the usual valve adaptor 2. The adaptor 2 is centrally bored so as threadingly to receive and retain the upper end of a metal filler tube 3 having an enlarged lower tip 4 provided with circumferentially spaced filler holes 5. The lower end of the adaptor 1 is provided with a circumferential groove 6 containing a rubber gasket 7.

Slidably disposed about the filler tube 3 is a metal bell-shaped bottle centering housing 8 which contains a metal bushing 9 the lower end of which has a rubber gasket 10.

In operation, bottles B to be filled with a beverage pass around a carousel located beneath a bottle filling machine. The latter usually consists of a rotatable member having a plurality of circumferentially spaced and depending bottle filling assemblies. Each filling tube of each such assembly commences sequentially to accept an ascending empty bottle as, simultaneously, the associated centering-bell positions itself about the open top of the bottle—such a position being shown in FIG. 1. It will be noted that in the position of the components shown in FIG. 1, the enlarged tip 4 of the filler tube 3 serves to limit the amount of downward movement of the bell 8 when the lower terminal end of said bushing 9 contacts the upper terminal end of said tip 4.

As the assembly continues its descent, the filler tube 3 projects into the interior of the bottle still further until all downward movement is prevented by the gasket 7 of the adaptor 2 striking the upper terminal end of the bell 8 — such a position being shown in FIG. 2.

From the above description, it will be appreciated that such a hitherto known device has had a number of points of wear requiring frequent replacements of components such as the gaskets 6 and 10 and the bushing 9 whilst still being adequate at speeds of 200–250 b.p.m. However, modern filling machines operate at far higher speeds such as, e.g. within the range of 725–750 b.p.m. Thus, replacements must be effected far more often than hitherto and this means, ignoring the cost of the maintenance of the parts which is no small factor, that the filling machines must be shut down far more frequently. The loss in production time is of some magnitude and, taken on an annual basis, can no longer be tolerated.

In addition, and because of the volumetric area of the flared portion of the bell 8, air pockets have formed therein as the bottles have engaged and disengaged the bells, it being well known that excess air reacts with bottled beer to cause, in time, a deleterious change in the product. Such a known filling device possesses many other disadvantages as will be enumerated later but those just described are the main disadvantageous features.

The improved filler tube assembly is shown in FIG. 3 where, insofar as possible, like references have been utilized. In particular, it will be seen that the flared portion of the bell-shaped bottle centering housing 8 has a much smaller volumetric area and that the upper end of said housing 8 is actually secured to the lower end of the adaptor 2 as a lock-tight press fit. Hence, said housing does not move on the filler tube and this obviates the provision of the prior art gasket 7 and any replacements thereof, as well as any replacement of the bushing 9.

In addition and because of the reduced volumetric area of the inside of the so-called flared portion of the bell 8, air pockets are inhibited during engagement and disengagement of the bottle B. The gasket 10 is of slightly different cross-section to that contained in the prior art device of FIGS. 1 and 2.

The other important difference resides in the lower end of the filler tub per se. As will be seen from FIG. 3, the lower end of the tube 3 is provided with a peripheral groove 5' containing the circumferentially spaced filler holes 5. Such an arrangement obviates the use of the enlarged tip shown in FIGS. 1 and 2 inasmuch as there is now no longer any necessity for the upper terminal end of the tip to act as a stop to limit the amount of downward movement of the bell . . . because the latter does not move in the improved device.

In addition, the top 4 of the tube 3 is tapered at 30° to the vertical axis of said tube. This has the advantage of guiding the tube into the bottle B in a more positive manner than heretofore and inhibiting chipping of the top of the bottle, adjacent the open mouth thereof, and also avoiding bending the tube 3.

I claim:

1. A bottle filler tube assembly including a valve adaptor serving as the mounting for the upper end of an axially bored liquid filling tube of elongated tubular configuration, a downwardly and outwardly flared bottle centering housing directly and fixedly secured to the lower end of said adaptor and through which said tube passes, a gasket within said housing adapted to contact the upper end of a bottle to be filled, the tip of said tube being closed and tapered at 30° to the longitudinal axis of said tube, the lower end of said tube having a reduced diameter peripheral groove portion through which extend a plurality of circumferentially unobstructed spaced filler holes.

* * * * *